US006531196B1

(12) United States Patent
Aho et al.

(10) Patent No.: US 6,531,196 B1
(45) Date of Patent: Mar. 11, 2003

(54) COATED BOARD, A PROCESS FOR ITS MANUFACTURE, AND CONTAINERS AND PACKAGING FORMED THEREFROM

(75) Inventors: Yrjö Aho, Rauha (FI); Tomi Kimpimäki, Turku (FI); Kari Nurmi, Raisio (FI); Tapani Penttinen, Huutjärvi (FI); Kimmo Santamäki, Turku (FI); Kari Yrjölä, Imatra (FI)

(73) Assignees: Stora Enso Oyj, Helsinki (FI); Raisio Chemicals Oy, Raisio (FI)

( * ) Notice: Subject to any disclaimer, the term of this patent is extended or adjusted under 35 U.S.C. 154(b) by 0 days.

(21) Appl. No.: 09/424,041

(22) PCT Filed: May 27, 1998

(86) PCT No.: PCT/FI98/00442

§ 371 (c)(1),
(2), (4) Date: Feb. 24, 2000

(87) PCT Pub. No.: WO98/54410

PCT Pub. Date: Dec. 3, 1998

(30) Foreign Application Priority Data

May 28, 1997 (FI) ..... 972246
Jan. 16, 1998 (FI) ..... 980086

(51) Int. Cl.[7] ..... D21J 1/08

(52) U.S. Cl. ..... 428/34.2; 428/34.3; 427/391; 427/411

(58) Field of Search ..... 428/34.2, 34.3; 229/5.81, 5.84; 427/411, 391; 162/136

(56) References Cited

U.S. PATENT DOCUMENTS

| | | | | | |
|---|---|---|---|---|---|
| 3,790,402 | A | | 2/1974 | Eastes | 117/68 |
| 3,972,572 | A | * | 8/1976 | Power | 428/452 |
| 4,410,573 | A | * | 10/1983 | Narymskaya et al. | 428/2 |
| 4,456,649 | A | * | 6/1984 | Clarke | 428/285 |
| 4,543,280 | A | * | 9/1985 | Fujita et al. | 428/35 |
| 4,775,560 | A | * | 10/1988 | Katsura et al. | 428/35 |
| 4,960,639 | A | * | 10/1990 | Oda et al. | 428/34.5 |
| 4,977,004 | A | * | 12/1990 | Bettle, III et al. | 428/36.7 |
| 5,475,080 | A | | 12/1995 | Gruber et al. | 528/354 |
| 5,573,693 | A | * | 11/1996 | Lorence et al. | 219/730 |
| 5,635,279 | A | | 6/1997 | Ma et al. | 428/174 |

FOREIGN PATENT DOCUMENTS

| | | | |
|---|---|---|---|
| EP | 0543793 | | 5/1993 |
| FI | 901928 | | 10/1990 |
| FI | 915541 | | 5/1993 |
| FI | 91786 | C | 4/1994 |
| GB | 2019822 | | 11/1979 |
| GB | 1593331 | | 7/1981 |
| JP | 52118016 | | 10/1977 |
| JP | 6264037 | | 3/1987 |
| JP | 404327298 | A * | 11/1992 |
| JP | 6264038 | | 9/1994 |
| SU | 652253 | A | 3/1979 |
| WO | WO 9313264 | A1 | 7/1993 |
| WO | WO9605054 | | 2/1996 |
| WO | WO9615321 | A1 | 5/1996 |
| WO | WO9622329 | A1 | 7/1996 |
| WO | WO 97/36050 | * | 10/1997 |

* cited by examiner

*Primary Examiner*—Harold Pyon
*Assistant Examiner*—Sow-Fun Hon
(74) *Attorney, Agent, or Firm*—Birch, Stewart, Kolasch & Birch, LLP

(57) ABSTRACT

The invention relates to coated board, a process for its manufacture, and containers and packaging formed therefrom. The board comprises at least one polymer-based coat preventing the transmission of liquids and gases, which coat is according to the invention made from a polymer dispersion to which talc particles are added so that talc will constitute 30–80% of the dry weight of the dried coat. The coating is applied onto the board during its manufacture as on-line coating. The board may be, for example, a multilayer board (2) which has a middle layer (6) containing CTMP or other similar mechanical pulp, on its both sides outer layers (7) formed from sulfate pulp, against these on both sides of the board (2) talc-containing polymeric barrier layers (3), and on one side of the board a heat sealing layer (9) introduced onto the barrier layer (3).

7 Claims, 2 Drawing Sheets

COATED BOARD, A PROCESS FOR ITS MANUFACTURE, AND CONTAINERS AND PACKAGING FORMED THEREFROM

This application is the national phase under 35 U.S.C. § 371 of PCT International Application No. PCT/FI98/00442 which has an international filing date of May 27, 1998, which designated the United States of America.

FIELD OF THE INVENTION

The present invention relates to coated board comprising at least one polymer-based coat which prevents the penetration of liquids and gases. Furthermore, the invention comprises a process for manufacturing the board, and dishes and packaging, such as food packaging formed from the board

DISCUSSION OF RELATED ART

The board used for packaging liquid foods and other products sensitive to spoiling must, for the sake of the durability of the product, be impermeable to liquid and gas. Such packaging board prevents airborne oxygen from penetrating to the inside of the package and, consequently, the product from spoiling and, respectively, the aromas which evaporate from the product from escaping from the package. In board used for disposable containers, it is important to have a liquid-resistant coat which protects the board from wetting.

One known method for rendering product packaging impermeable to liquid and gas is to provide the board used for the packaging with a metal foil. However, the disadvantages of such packaging include high manufacturing costs, non-biodegradability of the foil layer, problems of regeneration of the packaging material, and the unsuitability of the packaging for heating in a microwave oven.

Because of the said problems associated with metal foil, a shift has been made in food packaging to increased use of boards in which the impermeability to liquid and gas has been achieved by means of one or more polymeric barrier layers. Among polymer materials, especially EVOH has excellent barrier properties but, for example, polyamide is also usable for the purpose. By combining various polymer materials, an impermeability substantially corresponding to that of aluminum foil has been achieved, but owing to the required successive barrier and bonding agent layers the board becomes complicated in structure and the consumption of polymer material is high.

The special problems of EVOH in packaging boards include its mechanical weakness and sensitivity to moisture. During the heat sealing of the board, the EVOH layer tends to be perforated by the steam escaping out of the board. In these respects polyamide is a material more durable than EVOH ,but its barrier properties are not equal to those of EVOH. There are known packaging boards in which the solution to the problem has been sought through a suitable combining of EVOH and polyamide. A common problem associated with on-line coating of boards with polymers continues to be the risk of sticking during the rolling subsequent to the drying of the coat. The sticking will damage the coat, which should specifically be unbroken and continuous in order to provide the desired impermeability to oxygen and water vapors. The large amount of polymeric material present in the coating layers also detract from the pulpability of the board during its recycling.

SUMMARY OF THE INVENTION

The object of the present invention is to provide a board provided with a polymer-based coat impermeable to liquids and gases, substantially avoiding the said disadvantages associated with known coated boards. Board according to the invention is characterized in that the coat is formed on the board during its manufacture from a polymer dispersion applied as on-line coating, to which dispersion talc particles have been added so that the talc will constitute. 30–80% of the total weight of the dried coat.

In the coated board according to the invention, impermeability to water, water vapor, oxygen and aromas can be achieved by means of suitable batching of talc, in addition to which the coat is impermeable to fats and oils. The barrier properties of the coat are based on the presence of a very pure talc made up substantially of small, flaky particles, typically less than 50 $\mu$m in size, while the polymer closing the gaps between the talc particles forms a continuous phase which finally ensures the impermeability of the coat. It should be noted that calling the coat polymer-based refers to the presence of the. said continuous polymer phase and not to the polymer necessarily constituting the largest ingredient proportion in the coat, a fact which can be observed even from the range of the weight proportion of talc.

Besides the achievable barrier properties, the talc-containing coat of board also has many other advantages over known coating materials. The talc-containing coat is not sensitive to moisture; it protects the board from wetting so that the board retains its mechanical strength. The coating is thus especially suitable. for disposable containers and for packaging of liquid foodstuffs. The talc-containing coating compound is also suitable, without problems, for on-line coating processes which are in use, and the coating does not have a tendency to stick when the completed board is wound on a roll. The coating withstands heating, for which reason the coated board is suitable, for example, for baking containers. The coating also improves the mechanical properties of the board by increasing its stiffness.

Furthermore, the talc-containing coating has good printing properties owing to the fact that its surface is not hydrophobic. It is possible to carry out printing without a corona treatment, which is required by many other polymers, such as polyethylene, used as coatings.

Since the presence of talc in the coating compound reduces the amount of polymeric coating material, the coated board according to the invention is better pulpable and thus easier to recycle than known boards having corresponding barrier properties. For the same reason the use of talc is preferable in terms of the compostability and biodegrability of the board.

DETAILED DESCRIPTION OF INVENTION

A talc-containing coat is in itself transparent, which maybe an advantage in some uses of the board. On the other hand, the talc-containing coating compound can be easily colored by adding pigments to the polymer dispersion forming the coat, applied onto the board.

The oxygen and water vapor barrier properties of a talc-containing coat depend on the basis weight of the coat and the amount of talc therein. Generally speaking, the dry weight of an individual talc-containing coat on either side of the board may vary within a range of 2–40 g/m$^2$. Preferably the weight of the coat is 5–40 g/m$^2$, by means of which it is possible to achieve impermeability of the coat to water vapor, and most preferably within a range of 8–20 g/m$^2$, in which case the coat can be made impermeable to oxygen, a so-called High Barrier coating with an oxygen permeability below 100 cm$^3$O$_2$/m$^2$·d. The proportion of talc is 30–80%, preferably 40–75%, of the weight of the dried coat.

Polymers suitable for the polymer basis of a coat according to the invention for a board include styrene butadiene, styrene acrylate, acrylate or vinyl acetate polymers and copolymers, or blends of these. The polymer may be prepared by using a monomer blend containing as its principal components vinyl acetate and a (methyl, ethyl, propyl or butyl) ester of acrylic acid and/or methacrylic acid and/or lower alcohols, or by using a monomer blend containing as its principal components styrene and a (methyl, ethyl, propyl or butyl) ester of acrylic acid and/or methacrylic acid and/or lower alcohols or by using a monomer blend containing as its principal components a (methyl, ethyl, propyl or butyl) ester of acrylic acid and/or methacrylic acid and/or lower alcohols and/or a copolymer of these. The said polymers form polymer latexes, i.e. polymer dispersions, which can be combined with talc particles and be applied onto board as a coat in which dispersed polymer particles join one another as a polymer phase which binds the talc particles together. Furthermore, polylactides, polyhydroxybutyrates/polyhydroxy-valerates, modified starches and other biopolymers which are compostable or entirely biodegradable can be mentioned as usable polymers which are especially advantageous.

The colorability, already pointed out above, of a talc-containing coat is an especially advantageous property, in particular in the packaging of foods which must be protected from the detrimental effect of ultraviolet light. The coat of board intended for food packaging may thus advantageously contain, in addition to talc, also some coloring pigment in an amount of at maximum 5% of the total coating layer. For example, soot, metal pigments, mineral pigments and organic pigments can be used.

In addition to talc, the coat may contain some other mineral component which serves as a filler. Examples of such components, the weight proportion of which is most preferably at maximum 30%, include titanium dioxide, calcium carbonate, kaolin and gypsum.

In a board to be used for food packaging and containers it may be preferable to incorporate into the coating compound a hydrophobic agent, for example, a wax dispersion such as paraffin wax, PE wax or a AKD wax dispersion, in an amount of at maximum 20% of the total weight of the coat. A hydrophobic coat, decreases the tendency of the food to adhere to the board. Wax, and a mineral pigment used together with it, additionally reduce the sticking together of the dried coats during rolling. A high wax content may, on the other hand, weaken the printing properties of the surface.

The forming of a coat on a board is preferably carried out by applying a talc-containing dispersion onto the board in two or more successive steps, the dispersion applied in the preceding step being dried before the subsequent application step. By such a step-wise coating procedure a coat of a better quality is achieved than by applying the entire amount of dispersion for the coat onto the board at one time.

Board intended for heat sealable packaging can, in addition to a talc-containing coat according to the invention, be provided with one or more polymeric heat sealing layers adhering to the coat. There may thus be a talc-containing coat on one side of the board and a heat sealing layer sealable to the said coat on the opposite side of the board. Alternatively, both sides of the board may be provided with a heat sealing layer, in which case at least on one side of the board the heat sealing layer is applied on top of a talc-containing coat. Suitable materials for the heat sealing layer include LD-polyethylene and heat sealing lacquers.

Since the heat sealing layer, contrary to the talc-containing coat, may in order to be printable require a corona treatment, it may be advantageous to introduce the heat sealing polymer onto the board only in narrow streaks in the areas of the heat seals to be produced. Thus the said polymer will not complicate the printing of the areas between the seals. At the same time, savings of material are achieved and the structure of the board and the products made therefrom is rendered lighter.

A board according to the invention, provided with a talc-containing polymer coat, is most preferably a multi-layer board comprising two or more fiber-based layers; its weight without the coats may be within a range of 130–500 g/m$^2$, preferably 170–350 g/m$^2$. One example is a three-layer board which comprises a thicker middle layer which is formed in part or entirely from a mechanical pulp, such as CTMP; on both sides of the middle layer there are thinner outer layers formed from a sulfate pulp. Onto the outer layers on both sides of the board there are introduced polymeric coats which, in accordance with the invention, include at least one talc-containing barrier layer. The said board in itself has a stiff and non-buckling structure, and the talc-containing coat according to the invention on one or both sides of the board gives the board additional stiffness. The talc-containing barrier provides the further advantage that the ingredients of wood origin present in. the mechanical pulp will not give detrimental odor or taste to the packaged product. If recycled paper pulp is used for making the board, the barrier layers correspondingly insulate the product from any impurities present in the board.

The process according to the invention for the manufacture of the coated board described above is characterized in that, in connection with the manufacturing process, there is applied onto the board as on-line coating a polymer dispersion to which talc particles are added so that in the completed board talc will constitute 30–80% of the total weight of the dried coat.

Of packaging according to the present invention, made from board in accordance with the above, there must be mentioned, above all, food packaging in which the talc-containing barrier layers of the board ensure the durability of the product. Products packaged in accordance with the invention are protected from airborne oxygen and from outside moisture, while the water, fat and aroma barrier properties of the coat preserve the quality of the product and prevent packaged products from damaging one another during storage. Examples of products to be packaged include moist or liquid foods, such as juices, water, milk and other milk products such as cream, buttermilk, yogurt and ice-cream. Also possible are dry foods such as flours, powders, breakfast cereals, and animal foods. For example, the inside plastic bags so far used in breakfast cereal packages will be unnecessary.

The board can be used not only for industrial product packaging but also for manufacturing various containers, such as disposable tableware. The shape of the package or container is not limited; cases, cartons, tubs, baking containers, cups, mugs, goblets, trays, plates, etc., are possible.

An especially advantageous area of application for products according to the invention consists of board for frozen-foods containers, in which an inside talc-containing coat prevents the product from sticking to the container. Examples of frozen products to be packaged include ready-made foods such as casseroles and ice-cream.

The packaging of products, other than foods requiring shielding against the transmission of oxygen, moisture and aromas may also come within the scope of the invention.

One example is cigarette boxes in which the talc-containing coat of the packaging board renders unnecessary. the aluminum foil shield used inside the boxes to date.

Uses outside the packaging field for coated board according to the invention further include post-cards and advertising posters. In the latter, coats which protect the board layer from wetting are a considerable advantage.

BRIEF DESCRIPTION OF DRAWINGS

The invention is described below in greater detail with the help of examples, initially with reference to the accompanying drawings, wherein.

DETAILED DESCRIPTION OF INVENTION

Figure 1:
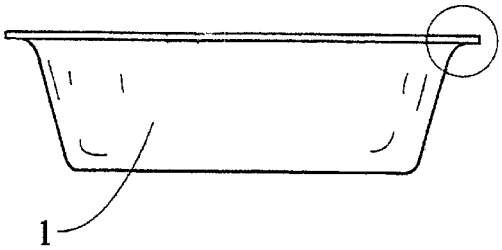
FIG. 1 depicts a frozen-foods container formed from board according to the invention.
Figure 2:
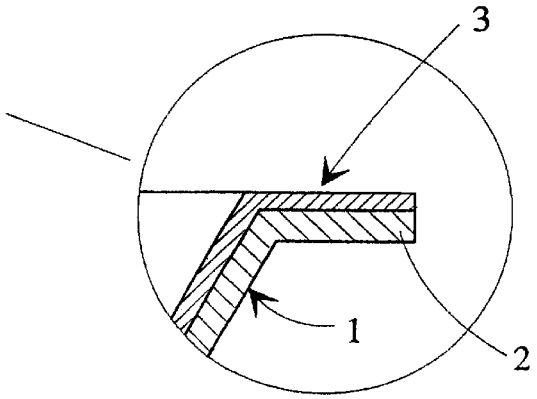
FIG. 2 depicts a cross-section of the edge of the container in an enlargement of FIG. 1.

The frozen-foods container 1 according to the invention, shown in FIGS. 1 and 2, suitable for example for packaging processed foods, is made of board 2 which is on the inside of the container coated with a polymer-based coat 3 which contains dispersed talc particles. The coat 3 serves as an oxygen and aroma barrier for the product in the closed container and at the same time protects the board 1 from moisture derived from the product.

Figure 3:
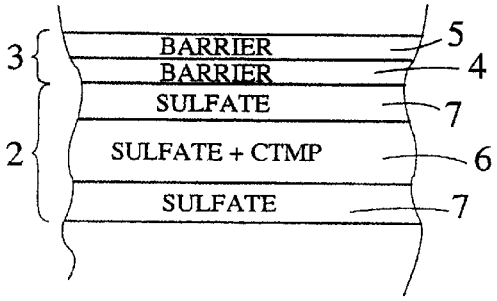
FIG. 3 depicts schematically the layered structure of the board used in the container according to FIGS. 1 and 2.

The structure of the coated board used for the frozen-foods container 1 according to FIGS. 1 and 2 is shown in greater detail in FIG. 3. The coat 3 is made up of a primer coat 4 of a talc-containing polymer dispersion, applied onto the board 2, and a top coat 5 of the same dispersion, on top thereof. These coats serve as a water, fat and oxygen barrier protecting the board 2. According to the example, the weight of each coat 4, 5 is 10 g/m$^2$. The three-layer board 2 under the coat is according to FIG. 3 made up of a thicker middle layer 6 which is a blend of sulfate pulp and CTMP and of thinner outer layers 7 on both sides of the middle layer, the outer layers being of sulfate pulp. The proportion of the middle layer 6 is approx. 60% and that of each outer layer 7 approx. 20% of the weight of the board 2. The total weight of the board 2, without the coats, is, for example, approx. 225 g/m$^2$.

Figure 4:
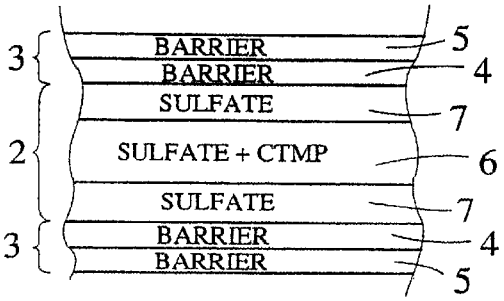
FIG. 4 depicts schematically a layer-structured board according to another embodiment of the invention.

FIG. 4 shows a coated board according to the invention which differs from that shown in FIG. 3 only in that the board 2 is provided on each side with a polymer-based coat 3 which contains talc particles, serving as a barrier. Each coat 3 is formed by a two-step coating process in which first a primer coat 4 is formed and thereafter a top coat 5.

Figure 5:
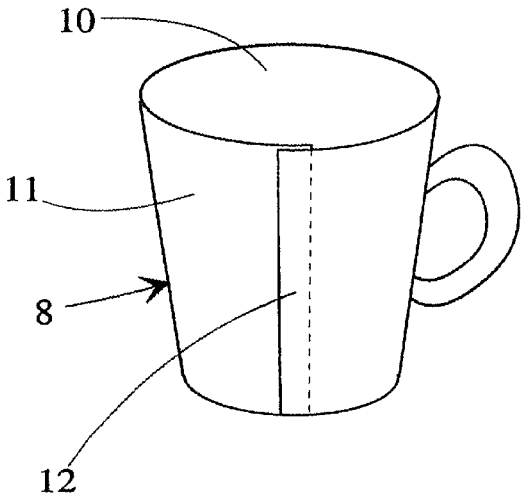
FIG. 5 depicts a disposable mug formed from a board according to the invention.
Figure 6:
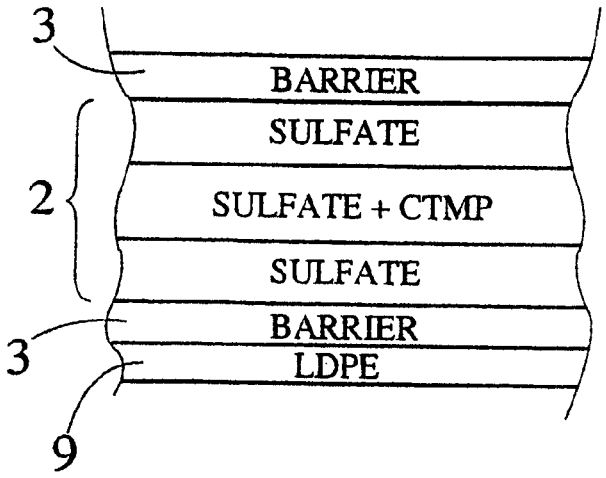
FIG. 6 depicts the layered structure of the board used in the mug according to FIG. 5.

FIG. 5 depicts a disposable drinking mug 8 according to the invention, and FIG. 6 shows the layer-structured board used for making it. This embodiment of the board differs from that shown in FIG. 4 in that on one side of the board there is topmost a heat sealing layer 9 of LDPE. The heat sealing layer 9 is applied onto the talc-containing coat 3 without a bonding agent layer between them. The talc-containing coats 3 may be made up of primer and top coats 4, 5 in a manner corresponding to FIGS. 3 and 4. In the mug 8 the board is oriented so that the inner surface 10 of the mug is formed by the LDPE layer 9 and the outer surface 11 is formed by the talc-containing coat 3 which constitutes a barrier. At the seal 12 the layers 3, 9 of the opposite sides of the board are heat sealed to each other.

Figure 7:
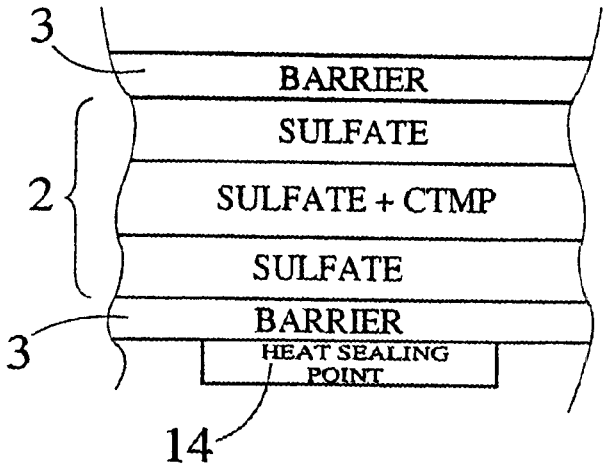
FIG. 7 depicts the structure of one further board according to the invention.

The layer-structured board according to FIG. 7 differs from that shown in FIG. 6 in that the heat sealing polymer is applied onto one side of the board only as a streak 14 at the heat sealing point. Outside the heat sealing points 14 the board surface is made up of a talc-containing barrier 3. This option saves heat sealing polymer and improves the printability of the surface.

Instead of LDPE it is possible to use for heat sealing a lacquer which is applied onto the packaging blanks in connection with the printing in the printing press.

The invention is illustrated further with the following embodiment examples.

EXAMPLE 1

Talc, either as a powder or granulated, was slurried in water according to the following formulation: 1585.6 g of water, 4.1 g of sodium polyacrylate and 16.2 g of sodium carboxymethyl cellulose were weighed into a dispersion vessel. High rotation speeds were used in the dispersion in order to break up talc agglomerates. Talc was added to the mixture gradually, in total 2700.0 g. Halfway through the adding of the talc, a further 4.1 g of sodium polyacrylate and 2.4 g of sodium hydroxide were added. The dispersing vessel was equipped with a cooling mantle, and the cooling of the slurry was started at 20 min from the ending of the talc adding step. Thereafter the dispersing was continued for another 20 min. The product obtained was a talc slurry having a solids content of 63.0% and a viscosity of 200 mPas, measured by using a Brookfield LVT viscometer with measuring head No. 3, at a rotation speed of 100 r/min. The final coating compound was obtained by mixing the talc slurry with a polymer latex.

EXAMPLE 2

Talc, either as a powder or granulated, was slurried in a polymer latex, according to the following formulation: 181.1 g of water, 1700.0 g of a polymer latex based on styrene butadiene (solids content 50%, second order transition temperature +20° C.), 3.4 g of sodium hydroxide and 1.7 g of organomodified siloxane were weighed into a dispersion vessel. High rotation speeds were used in the dispersing in order to break up any talc agglomerates. Talc was added to the mixture gradually, in total 1700.0 g. The dispersion vessel was equipped with a cooling mantle, and the cooling of the slurry was started at 20 min from the ending of the talc adding step. Thereafter the dispersing was continued for another 20 min. The product obtained was a coating compound having a solids content of 68.0% and a viscosity of 1150 mPas measured by using a Brookfield LVT viscometer with measuring head No. 4, at a rotation speed of 100 r/min.

The following examples describe the effect of completed coating compounds prepared by the technique according to Examples 1 and 2, applied onto board, on the properties of the board. The permeability measurements in the examples were made, unless otherwise stated, in the following conditions:. air temperature 23° C. and relative humidity 50%. The unit for water permeability was g/m$^2$, for water vapor permeability g/m$^2$·d, and for oxygen permeability cm$^3$/m$^2$·d.

EXAMPLE 3

A styrene-butadiene-based coating compound which contained different amounts of talc was applied by means of a laboratory coating machine onto a board, from which water vapor transmission rates (WVTR) were measured. The transmission rates of the coatings are shown in Table 1.

TABLE 1

| | Proportion of talc in coating compound (%) | | | | | |
|---|---|---|---|---|---|---|
| | 9 | 20 | 35 | 50 | 65 | 80 |
| Coating thickness ($\mu$) | 10 | 9.5 | 10 | 10 | 7.5 | 7.5 |
| WVTR (g/m2 · d) | 15 | 10.8 | 9.8 | 9 | 7 | 6.2 |

EXAMPLE 4

Value PA in Table 2 shows the pulpability properties of board treated with a coating compound which contained a talc-containing polymer latex based on styrene butadiene. The value was determined as follows: the treated board was disintegrated according to the method SCAN-C 18:65. Laboratory sheets were prepared from the stock. The quality of the sheet was assessed on a scale of 0–5, where 0 stands for good pulpability (no accumulations due to the coating compound are observed) and 5 stands for poor quality (a great deal of accumulations of the coating compound or unevenness due to poor disintegration of the pulp).

TABLE 2

| | Proportion of talc in coating compound | | | | |
|---|---|---|---|---|---|
| | 0 | 20 | 40 | 60 | 80 |
| PA | 4 | 3 | 2 | 1 | 0 |

EXAMPLE 5

This example illustrates differences in the permeability properties of the coating, when the same coating compound, which contains a polymer latex based on styrene butadiene and has a talc content of approx. 50%, is applied onto board either once or twice so that the final thickness of the dry coat in each case is the same, approx. 14 $\mu$m. Table 3 shows the effect of the two different application concepts on both the water transmission and the water vapor transmission of the coat.

TABLE 3

| Number of coatings | 1 coating | 2 coatings |
|---|---|---|
| Cobb600 (g/m2) | 1.2 | 0.6 |
| WVTR (g/m2 · d) | 9.8 | 7.5 |

EXAMPLE 6

Onto a 285 g/m$^2$ board there was first applied a coating compound with a composition of a talc-containing polymer latex based on styrene butadiene 50% and a polymer latex based on polyvinyl acetate/acrylate 50%. On top of the first coat there was applied a second coat which contained a talc-containing polymer latex based on styrene butadiene, calcium carbonate and wax. The amounts of coating compound in both coats were approx. 10 g/m$^2$ solids. Table 4 shows the water transmission and water vapor transmission properties given to the coat by the combination of the said coating compounds.

TABLE 4

| | |
|---|---|
| Cobb600 (g/m2) | 0.6 |
| WVTR (g/m2 · d) | 2.8 |

EXAMPLE 7

Onto a 285 g/m$^2$ board there was applied a coating compound having a composition of talc 50% and, in varying proportions. a polymer latex based on styrene butadiene and a polymer latex (second order transition temperature +60° C.) based on butyl acrylate The amount of coating compound was approx. 12 g/m$^2$ solids. Table 5 shows the water permeability properties given to the coat by the said combination of coating compounds.

TABLE 5

| Proportion of styrene butadiene in the polymer latex, % | 0 | 10 | 20 | 40 | 60 | 80 | 90 | 100 |
|---|---|---|---|---|---|---|---|---|
| Cobb600 (g/m2) | 2.1 | 1.5 | 2.6 | 2.7 | 5.0 | 10.3 | 20.1 | 32.6 |

EXAMPLE 8

A coating compound which contained talc approx. 65% and a polymer approx. 35% was used for coating board at a speed of 450 m/min in a board machine. The coating was carried but both as a single coating and as a double coating. The transmissions of water, water vapor, fat, and oxygen were measured from the samples obtained. The fat resistance test was carried out according to the ASTM standard. The results obtained are compiled in Table 6.

TABLE 6

| Amount of coating compound (g/m2) | Cobb 900 | WVTR | O2TR | Oil resistance |
|---|---|---|---|---|
| 8 | 30 | 41 | | no transmission |
| 15 | 8 | 11 | 50–100 | no transmission |

EXAMPLE 9

A coating compound which contained talc approx. 65% and a polymer approx. 35% was used for pilot coatings from which transmission rates were measured. Board was coated both on one side and on both sides. The results are in Table 7. The water vapor measurement conditions were: temperature 28° C. and relative humidity RH 50%.

TABLE 7

| Board grade | Amounts of coating (g/m2) on top side/back side | Cobb 600 | WVTR | Pinholes | Fat resistance |
|---|---|---|---|---|---|
| Drinking cup board | 0/26 | <1 | 7.5 | none | >1 d |
| CTMP-containing board | 0/20 | 2 | 16.5 | none | >1 d |

TABLE 7-continued

| Board grade | Amounts of coating (g/m2) on top side/back side | Cobb 600 | WVTR | Pinholes | Fat resist-ance |
|---|---|---|---|---|---|
| Other solid board | 9/36 | <1 | 11 | none | >1 d |

EXAMPLE 10

The pulpability and stickiness of a dispersion coating compound which contained talc approx. 65% and a polymer approx. 35% were studied in a pilot paper machine pulper and with wet end recycling. The amounts of coating were within a range of 20–40 g/m$^2$, and the boards used were boards according to Example 9. The pulping temperature was 40–60° C. and the pulping time was 1–3 hours. The pulp thus obtained was run through the pilot paper machine for a total of 15 hours during three days while minimizing the water consumption of the paper machine. According to the results the pulping was very successful and no sticky substances accumulated on the wire during the entire time. The analysis of the tail water yielded results corresponding to normal waste pulp.

EXAMPLE 11

A coating compound containing talc approx. 12 g/m$^2$, the proportion of talc being approx. 35% and the proportion of polymer approx. 65%, was applied onto the surface of board by means of a pilot coating machine. This coat was heat sealed against itself; against a fiber material and against PE. Table 8 shows the sealing results, 0 standing for a poor seal and 5 a perfect seal.

TABLE 8

| Sealing temperature ° C. | 80 | 100 | 120 | 140 | 160 | 180 |
|---|---|---|---|---|---|---|
| Coating-coating | 0 | 5 | | | | |
| Coating-fiber | | 2 | 4 | 5 | | |
| Coating-PE | | | | 0 | 1 | 5 |

EXAMPLE 12

A coating which contained talc approx. 65% and a polymer approx. 35% was used for coating a three-layer board (Enso Natura L 240 g/m$^2$) both on one side and both sides of the board. In the middle layer of the board, CTMP was used in addition to chemical pulp. The reference samples were an uncoated board and boards pigment-coated on one side and on both sides. The estimated amount of coating compound in each coat was approx. 10 g/m$^2$.

The board was subjected to a Cobb test (5 min) , whereafter the stiffness was measured from the samples wetted in the Cobb test. According to the results, the stiffness of a board coated with a coating compound of the type of Example 2 was approx. 90%; of the original stiffness, whereas the stiffness of the pigment-coated board and the uncoated board was only 25% of the original stiffness.

The results of the measurements are shown in Table 9.

TABLE 9

| | Cobb 5 min | Bending resistance (mN) | |
|---|---|---|---|
| | (g/m2) | before | after |
| Board | 40 | 211 | 75 |
| Board + pigment | 54.5 | 227 | 60 |
| Board + pigment on both sides | 57.6 | 250 | 61 |
| Board + coating of Example 2 | 3.3 | 212 | 181 |
| Board + coating of Example 2 on both sides | 2.5 | 224 | 214 |

EXAMPLE 13

35 g of oxidized starch Raisamyl 302P was slurried in 150 g of water and was transferred to a pressure-resistant reactor vessel. The temperature of the mixture was raised to 100° C. and was kept at that for 20 min to dissolve the starch grains. Thereafter the mixture was cooled to 70° C., and a solution which contained 2.5 g of sodium lauryl sulfate in 50 ml of water was added to it. To this mixture there was added gradually in the course of two hours from a pressure burette a monomer blend which contained 117 g of styrene and 74 g of a butadiene washed with a lye solution,. as well as 3 g of acrylic acid. From another pressure burette, an initiator solution was added which contained 3 g of ammonium persulfate in 70 g of water. The polymer reaction was allowed to continue for 12 hours. The product obtained was a white dispersion having a solids content of 46% and a viscosity of approx. 900 mPas, measured by using a Brookfield LVT viscometer with measuring head No. 2, at a rotation speed of 100 r/min. The measurements were carried out after the product had been neutralized with NaOH to a pH of 7. The calculated starch content of the product was approx. 13%.

95.2 g of a talc slurry according to Example 1 was mixed with 304.3 g of a polymer dispersion according to the above method. The talc slurry was added to the polymer dispersion gradually for 10 min by using relatively high rotation speeds. 4 g of an organomodified polysiloxane was added to the 399.5 g of coating compound obtained. The solids content of the final coating compound was approx. 50%. The obtained polymer-dispersion-based coating compound was applied by means of a laboratory coating machine once onto a 265 g/m$^2$ board and was dried by using an IR drier to a final moisture content of 6%. The dry weight of the coat was approx. 12 g/m$^2$. The water vapor transmission rate (WVTR) was measured from the dispersion-coated board at a temperature of 23° C. and a relative air humidity of 50%. The water vapor transmission rate obtained by a gravimetric method was approx. 32 g/m$^2$, 24 h.

What is claimed is:

1. A frozen food container made of a coated board, the container having the shape of a cup or tray, and the board consisting of a fiber board base of a weight from 130–500 g/m$^2$ and one or more superimposed polymer-based coat layers, said layers comprising a barrier coat having a continuous fused polymer phase with talc particles embedded therein, wherein the talc particles constitute 30–75% of the total weight of the coat, said barrier coat lying on the inside of the container in contact with the food and constituting a barrier to liquid and gas transmission; and wherein the fiber board base has a middle layer of a blend of sulfate pulp and chemithermomechanical pulp and layers of sulfate pulp on both sides of the middle layer.

2. A frozen food container made of a coated board, the board consisting of a fiber board base of a weight from 130–500 g/m$^2$ and one or more superimposed polymer-based coat layers, said layers comprising a barrier coat having a continuous fused polymer phase with talc particles embedded therein, wherein the talc particles constitute 30–75% of the total weight of the coat, said barrier coat lying on the inside of the container in contact with the food and constituting a barrier to liquid and gas transmission; wherein the board comprises a three-layer fiber board base under said barrier coat; and wherein the three-layer fiber board base has a middle layer of a blend of sulfate pulp and chemithermomechanical pulp and layers of sulfate pulp on both sides of the middle layer.

3. A frozen food container according to claim 1 wherein the coated board has been made by a process comprising applying a polymer dispersion containing talc particles onto a fiber board base as on-line coating in a board machine, the dispersed polymer particles being joined to one another to form in the finished dried coat a continuous polymer phase between talc particles embedded therein, said polymer phase consisting of the polymer of said dispersed polymer particles and being formed without use of a cross-linking agent, and talc being used in an amount to form 30–75% of the total weight of the dried coat.

4. A frozen food package, which is a closed package comprising a container shaped as a tray with an edge rim and forming a substrate for ready-made food contained in the package, said tray being made of a board of superimposed material layers consisting of a fiber board base of a weight from 130 to 500 g/m$^2$ and at least one polymer-based coat applied onto the board base in a board machine and having a continuous fused polymer phase with talc particles embedded therein, wherein the talc particles constitute 30–75% of the total weight of the coat, said coat forming the inside of the tray in contact with the packaged food and constituting an oxygen and aroma barrier and a barrier to liquid transmission; wherein the board comprises a three-layer fiber board base under said barrier coat, and wherein the three-layer fiber board base has a middle layer of a blend of sulfate pulp and chemithermomechanical pulp and layers of sulfate pulp on both sides of the middle layer.

5. A food package comprising a container shaped as a tray with an edge rim, said tray being made of a board of superimposed material layers consisting of a fiber board base of a weight from 130 to 500 g/m$^2$ and at least one polymer-based coat having a continuous fused polymer phase with talc particles embedded therein, wherein the talc particles constitute 30–75% of the total weight of the coat, said coat forming the inside of the tray in contact with the packaged food and constituting a barrier to liquid and gas transmission; wherein the board comprises a three-layer fiber board base under said barrier coat, and wherein the three-layer fiber board base has a middle layer of a blend of sulfate pulp and chemithermomechanical pulp and layers of sulfate pulp on both sides of the middle layer.

6. A disposable drinking mug made of coated board comprising a fiber board base of a weight 130–500 g/m$^2$, and at least one polymer-based coat on the board base, the coat comprising a continuous fused polymer phase with talc particles embedded therein, wherein the talc particles constitute 30–75% of the total weight of the coat; wherein the board comprises a three-layer fiber board base under said barrier coat, and wherein the three-layer fiber board base has a middle layer of a blend of sulfate pulp and chemithermomechanical pulp and layers of sulfate pulp on both sides of the middle layer.

7. A disposable drinking mug made of coated board comprising a fiber board base of a weight from 130–500 g/m$^2$, and at least one polymer-based coat on the board base, the coat comprising a continuous fused polymer phase with talc particles embedded therein, wherein the talc particles constitute 30–75% of the total weight of the coat; wherein the three-layer fiber board has a middle layer of a blend of sulfate pulp and chemithermomechanical pulp and layers of sulfate pulp on both sides of the middle layer.

* * * * *